US008419357B2

(12) United States Patent
Haje

(10) Patent No.: US 8,419,357 B2
(45) Date of Patent: Apr. 16, 2013

(54) APPARATUS AND METHOD FOR REDUCING THE PRESSURE ON A JOINT BETWEEN AT LEAST TWO DELIMITING PARTS

(75) Inventor: Detlef Haje, Görlitz (DE)

(73) Assignee: Siemens Aktiengesellschaft, München (DE)

( * ) Notice: Subject to any disclaimer, the term of this patent is extended or adjusted under 35 U.S.C. 154(b) by 596 days.

(21) Appl. No.: 12/553,236

(22) Filed: Sep. 3, 2009

(65) Prior Publication Data

US 2010/0054925 A1 Mar. 4, 2010

(30) Foreign Application Priority Data

Sep. 3, 2008 (DE) ..... 10 2008 045 657

(51) Int. Cl.
*F03D 11/00* (2006.01)

(52) U.S. Cl.
USPC ..... 415/176; 415/180

(58) Field of Classification Search ..... 415/115, 415/116, 175, 176, 178, 180, 144; 60/796, 60/797; 277/928, 408
See application file for complete search history.

(56) References Cited

U.S. PATENT DOCUMENTS 4,296,538 A * 10/1981 Straslicka ..... 29/888.3
4,497,172 A 2/1985 Smith

FOREIGN PATENT DOCUMENTS

DE 2755356 C3 4/1984
DE 103 93 433 T5 9/2005
EP 1 744 017 A1 1/2007
JP 11229817 A * 8/1999

* cited by examiner

*Primary Examiner* — Nathaniel Wiehe
*Assistant Examiner* — Adam W Brown

(57) ABSTRACT

An apparatus, especially a steam turbine, including a first delimiting part and a second delimiting part is provided. The delimiting parts are attached to one another forming a joint and enclosing at least a part of a first pressure chamber. A shielding element is also provided on the sides of the delimiting parts facing towards the first pressure chamber and is arranged to form a seal completely covering the joint, so that a cavity is formed between the delimiting parts and the shielding element. A line is routed in the cavity connecting the cavity to a second pressure chamber. In addition, a method for decreasing the force acting on a joint, which is formed by the joining together of a first delimiting part and a second delimiting part of an apparatus, especially a steam turbine, and for reducing the attachment forces acting on the joint is provided.

15 Claims, 2 Drawing Sheets

APPARATUS AND METHOD FOR REDUCING THE PRESSURE ON A JOINT BETWEEN AT LEAST TWO DELIMITING PARTS

CROSS REFERENCE TO RELATED APPLICATIONS

This application claims priority of German application No. 10 2008 045 657.8 DE filed Sep. 3, 2008, which is incorporated by reference herein in its entirety.

FIELD OF INVENTION

The present invention relates to an apparatus, especially a steam turbine, featuring at least one first delimiting part and at least one second delimiting part, with the delimiting parts able to be attached to each other by forming a joint and in doing so enclosing at least one part of a first pressure chamber. The invention further relates to a method for lowering the pressure acting on a joint formed by joining together at least a first delimiting part and at least a second delimiting part of an apparatus, especially a steam turbine, and for reducing attachment forces acting on the joint, with the delimiting parts enclosing at least one part of a first pressure chamber.

BACKGROUND OF INVENTION

In steam turbines a flow channel is formed by different delimiting parts or flow channel parts which are joined together. The flow channel formed is subjected to hot steam under high pressure. Along the longitudinal axis of the flow channel pressure chambers are formed with differing levels of internal pressure. It is thus of decisive importance for the connection between the different delimiting parts to be sufficiently tight so that no leakages occur. This is especially difficult since, with a steam turbine, steam temperatures or live steam temperatures of more than 600° C. can occur at a steam pressure of more than 250 bar.

At the connection between at least two delimiting parts of the flow channel a joint is formed, with four delimiting parts a so-called cross joint. A cross joint features both a horizontal joint and also a vertical joint. It is necessary to form a cross joint if, for manufacturing reasons or because of the materials selected, the first delimiting parts and the second delimiting parts of the flow channel must be embodied separately. As a rule, the delimiting parts feature different materials with different coefficients of thermal expansion and different constructions. Thus one delimiting part can be formed from a steel casting and the other delimiting part can be formed as a welded construction or from a spheroidal casting. The flange connection at the joints, especially the cross joints, is to be designed for overpressure, for a vacuum or mostly for changing pressure conditions.

The design of steam turbine housings with a cross joint has the advantage of the manufacturing of the blanks and the processing of the delimiting parts being able to be undertaken on smaller components in each case. This allows benefits to be obtained both in relation to the costs and also in relation to procurement and processing capacity. The disadvantage of cross joints however is that, because of the limited space around the intersection point of the joints, there are only limited opportunities for screwing them securely together. Thus there is a greater danger of leakage with cross joints than with other joints and they are only designed for steam turbines up to specific restricted steam parameters.

The practice of equipping cross joints with suction outlets is known in order to catch any leakage quantities occurring.

Also known is the practice of welding a sealing seam onto the inside of the vertical joint. The problem here is that of designing the welded joint to be secure and allow sufficient thermal expansion, so that damage is avoided even with non-steady-state processes. The high pressures and temperatures involved can result in expansions of the corresponding delimiting parts, so that cracks and thereby leakage can occur at the welded seam.

SUMMARY OF INVENTION

The object of the invention is to create an apparatus and a method which make it possible to lower or to reduce the pressure and the forces on a joint, especially on a cross joint, between at least two delimiting parts of the apparatus, especially of a steam turbine when high pressures arise during the operation of the apparatus. In particular a larger usable area is to be made accessible to a cross joint at delimiting parts of a steam turbine.

This object is achieved in accordance with the invention by an apparatus, especially a steam turbine, with the features claimed in the claims as well as by a method with the features claimed in the claims. Further features and details of the invention emerge from the subclaims, the description and the drawings. In this case features and details which are described in conjunction with the inventive apparatus, especially the steam turbine, naturally also apply in conjunction with the inventive method, and vice versa, so that, in relation to the disclosure for the individual inventive aspects, reference is always made to both areas.

In accordance with a first aspect of the invention the object is achieved by an apparatus, especially a steam turbine, featuring at least one first delimiting part and at least one second delimiting part, with the delimiting parts being able to be attached to one another while forming a joint and in this case enclosing at least a part of a first pressure chamber, in which a shielding element is provided on the sides of the delimiting parts facing towards the first pressure chamber which is arranged to form a seal in relation to the at least one first delimiting element and the at least one second delimiting element and in doing so fully covers the joint, so that a cavity is formed between the delimiting parts and the shielding element, and that a line is routed in the cavity which connects the cavity with a second pressure chamber.

Central to the invention is that the area of the joint which faces the first pressure chamber has a lower pressure applied to it than obtains in the flow channel during operation of the apparatus, especially the steam turbine. The pressure reduction at the joint also enables the forces acting on the attachment of the delimiting parts, especially the axial forces, to be reduced. The at least one first and one second delimiting part of the apparatus are joined to each other. A joint, especially a cross joint, is formed at the connecting point. The delimiting parts are especially attached to each other by means of attachment screws. The shielding of the joint or of the cross joint enables the pressure on the joint to be reduced and thus especially the axial forces on the attachment screws of the flange connection between the delimiting parts to be reduced.

Inventively a shielding element is provided on the sides of the delimiting parts facing the first pressure chamber which is arranged to form a seal in relation to the at least one first delimiting element and the at least one second delimiting element and in doing so fully covers the joint. The covering of the joint by the shielding element means that a cavity is formed between the delimiting parts and the shielding element in the area of the joint. A line is routed in this cavity which connects the cavity to a second external pressure chamber. If the delimiting parts form a flow channel of a steam turbine, the area of the joint or of the cross joint respectively is protected on the steam side by the shielding element, so that in this shielded area lower ambient parameters, i.e. a lower pressure and a moderate lower temperature, can be set. By connecting the cavity to the second pressure chamber the pressure in the cavity can be adapted to the pressure in the second pressure chamber.

The shielding effect is achieved by a shielding element located within the first pressure chamber formed by the delimiting parts completely covering the joint or the cross joint respectively and sealing the joint on all sides, i.e. being arranged to form a seal in relation to the at least one first delimiting part and at least one second delimiting part. The pressure is reduced by the line which connects the cavity between the shielding element, the delimiting parts and the joint to a second pressure chamber lying further downstream in the expansion. The second pressure chamber or the line to the second pressure chamber can be attached for example to the inner side of the at least one first delimiting part and/or the at least one second delimiting part or to a guide vane of the apparatus, especially of the steam turbine.

This type of apparatus or this type of steam turbine respectively enables the usable area of a jointed connection, especially of a cross jointed connection between the delimiting parts, to have a greater usable area made available to it.

This type of apparatus or this type of steam turbine respectively enables a lowering of the pressure in the cavity by around 15 to 20 bar to be achieved compared to the pressure in the first pressure chamber of the steam turbine formed by the delimiting parts. Furthermore a reduction of the effective internal-pressure-related axial pressures on the attachment screws by around ⅓ compared to usual steam turbines is possible. The pressure reduction is accompanied by a moderate temperature reduction by throttling. This throttling is effected by the pressure reduction of any leakage mass flows from the interior into the cavity without any technical work being undertaken.

The shielding element can be embodied in various ways. Thus for example it can have an angled or curved profile.

The joint can be embodied for example as a butt joint as well as a cross joint. In this case three delimiting parts butt against each other.

The at least one first and the at least one second delimiting part preferably represent rotationally-symmetrical or essentially rotationally-symmetrically embodied elements. Essentially rotationally-symmetrical means that the elements can have cylindrical, spherical or curved subareas. Essentially rotationally-symmetrical elements can feature non-rotationally-symmetrically embodied extensions or sections, such as admissions, reinforcements or flanges at specific points. These rotationally-symmetrically or essentially rotationally-symmetrically embodied elements form the flow channel of the apparatus or of the steam turbine. More then two delimiting parts can be provided, with the joints or the cross joints being shielded between the respective delimiting parts in accordance with the invention. The shielding element preferably features a rotationally-symmetrical or essentially rotationally-symmetrical profile.

An apparatus is preferred in which the line to the cavity is routed through one of the delimiting parts or through the shielding element. The line is preferably embodied as a pipe and advantageously connects the cavity with a second pressure chamber lying downstream, i.e. downstream in the expansion. In this case the line, especially the pipe, can be routed partly or entirely within and/or outside the delimiting parts, i.e. of the first pressure chamber.

Furthermore an apparatus or a steam turbine is preferred in which the shielding element and the sealing of the shielding element are embodied to allow thermal expansion. This allows different deformations of the delimiting parts or of the shielding respectively resulting from the high temperatures and the high pressures obtaining at some times to be compensated for.

Especially preferred is an apparatus or a steam turbine in which the shielding element is attached to at least two supports running around the delimiting elements, especially suspended, or the shielding element seats to form a seal on the delimiting parts through at least two seals allowing thermal expansion or the shielding element is attached, especially suspended, on at least one support running around the element and seats to form a seal on the at least one other delimiting part by at least one seal allowing thermal expansion. There can thus be provision for a support running around the element to be provided on an inner side of the first delimiting parts, to which a first axial area, especially a first free end, of the shielding element is attached to form a seal, and for a seal allowing thermal expansion to be provided between the inner side of the second delimiting parts and a second axial area, especially the second free end, of the shielding element. The first axial area or the first free end of the shielding element can be attached to the circumferential support for example by means of screw connections or by insertion into a circumferential groove. In this case the shielding element is advantageously fixed axially as well as radially to the longitudinal axis of the flow channel to the circumferential support. For better sealing a sealing element can be provided for this attachment. If the sealing element is seated to form a seal by at least two seals allowing thermal expansions in relation to the delimiting parts, the shielding element will preferably be fixed axially by an axial fixing. This fixing can be made to a delimiting part or to a circumferential groove. Screw connections in particular are suitable for this purpose.

Also preferred is an apparatus in which at least one circumferential support is formed by a stator part. The stator part is fixed to seal against at least one delimiting part. Furthermore the circumferential support can be formed by a circumferential web projecting inwards and/or axially. The form or the design of the at least one circumferential support can differ.

It is further preferred for at least one seal allowing thermal expansion to seat to form a seal on the at least one circumferential support, especially on the stator part or on the surrounding web.

The seal allowing thermal expansion can be formed by a compressible and/or spring-loadable piston ring, by a labyrinth or see-through seal or by at least one sealing plate. Piston ring seals and labyrinth seals in particular can be used to very good effect under extreme operating conditions, meaning at high pressures and temperatures. Labyrinth or see-through seals cannot exhibit any play. It is also conceivable for a number of seals or sealing plates to be provided for sealing allowing thermal expansion, especially of a free end, of the shielding element.

With the other preferred apparatus at least one of the delimiting parts of the apparatus has a groove to accept the seal allowing thermal expansion. This creates an especially good attachment and sealing of the shielding element on the corresponding delimiting parts. It has been shown that introducing a piston ring seal into the groove forms a particularly effective seal. The seal can be made in the groove in this case.

Furthermore an apparatus or a steam turbine is preferred in which the seal allowing thermal expansion is a split seal. One part of the split seal is able to be separated after lifting the first delimiting part in the vicinity of the joint, especially of the cross joint, so that afterwards the remaining part of the shielding can be dismantled. Thus a piston ring in two parts and with two butt ends can be provided as a split seal. This type of split seal can be arranged directly on the shielding element and/or on one of the delimiting parts and/or on at least one circumferential support. A butt end forms a separation point on the circumference of the piston ring. The thrust points have seals and optional serrations.

Because of the possible expansion of individual components through the flow of heat, the line is flexibly embodied and/or at least supported to allow movement at the breakthrough to the cavity. This enables to situation to be avoided of the line fracturing if a thermal expansion of individual components occurs. Despite the ability of the line to move or flex respectively, it is arranged sealed in the passage to the cavity. If the line is embodied as a pipe, this is preferably supported to allow movement, since the pipe is embodied with less flexibility than an inherently flexible line.

In a further preferred embodiment of the apparatus, especially of the steam turbine, there is provision for the shielding element to be divided into at least two parts, with the at least two parts of the shielding element able to be attached to each other to form a seal. It is especially advantageous for the screening element to be divided axially. There can thus be provision for the segment of the shielding element on which the seal allowing thermal expansion is arranged to be attached to the second delimiting part and for the second segment to be arranged on the first delimiting part. In this exemplary embodiment the segment with the seal allowing thermal expansion, after the dismantling of the first delimiting part and of the second segment of the shielding element, can be lifted out together with the rotor of the steam turbine and subsequently dismantled. In such an embodiment of the shielding element a piston ring seal is especially well proven. The respective segments of the shielding element can be fixed to seal against each other using screw connections and seals which allow thermal expansion.

Preferably the shielding element of the apparatus features at least one preheating hole. An explicit mass flow of the heating steam flowing in the flow channel can be diverted into the cavity through a preheating hole. As an alternative or in addition seals allowing thermal expansion that have specific leakages can be used. Seals having such leakages let moderate leakage quantities through the seals. Furthermore a preheating line lockable by a locking element can be routed to the cavity. These measures serve to achieve an improved steady-state behavior of the shielded joint or cross joint. They make possible a temporary increase in the coefficients of thermal transfer of the shielded components and do so with the aid of a temporary increases in pressure between the shielding, i.e. the shielding element, and the joint or the horizontal joint of the cross joint. This is typically done by explicitly feeding in a specific amount of the originally shielded hot steam. The shielded hot steam can be fed into the cavity at intervals via the lockable preheating line. The preheating line features at least one locking element. This locking element can for example be a slider, a regulator, a tap or a valve. Other types of locking elements are also conceivable however. If the shielding element features preheating holes or the seals have specific leakages, a specific amount of hot steam can be directed continuously to the cavity. So that the fed-in hot steam can be held in the cavity, the line to the pressure chamber also has a locking element, which can be closed if necessary in order to briefly increase the temperature and the pressure in the cavity. The locking element of the line can also be embodied as a slider, a regulator, a tap, a valve etc.

The locking element in the line to the second pressure chamber especially enables the operating conditions within the cavity to the easily regulated. The locking element in the line makes possible a temporary build-up of the pressure and also of the temperature in the cavity and in the connecting line to the second pressure chamber generally lying downstream. After a desired temperature level has been reached in the cavity and/or in the flange sections of the joint, especially the cross joint or in the sections of the delimiting parts decisive for non-steady state operation, the line to the second pressure chamber is fully opened again so that for steady-state operation a reduced pressure is again set in the cavity and thereby at the joint. Opening the line also allows the temperature level in the cavity or in the line to be regulated again.

Furthermore an apparatus is preferred in which at least one cooling steam line able to be locked by means of a locking element is routed to the cavity, via which cooling steam is able to be fed into the cavity. This means, in addition to the improvements previously mentioned in respect of the pressure at the joint or at the cross joint and the axial force arising as well as the possible moderate temperature reduction, that a further steady-state temperature drop can be achieved at the joint or the vertical joint of the cross joint respectively. This is required for example if permitted usage temperatures of delimiting parts, of the shielding element or of screw materials must be adhered to or when an increase in the design stress values must be achieved as the component temperatures decrease. To this end the cooling steam is advantageously routed from a first point lying downstream in relation to the joint through the cooling steam line into the cavity between the shielding element and the joint and is routed back through the line to a second point lying further downstream. The pressure in the cavity can be set by a specific line arrangement, especially pipe arrangement and a possible pressure buildup in the line also referred to as a drain line and this can be done at the limits of the pressure level of the first and the second point. This solution is challenging in control technology terms and demands a more massive embodiment of the shielding, i.e. of the shielding element. The additional benefits of the described measures for temperature lowering can then be checked in specific cases. The preheating line, the cooling steam line and the drain line feature corresponding locking elements through which a regulation of the pressure level is made possible. The locking elements can for example be a slider, a regulator, a tap or a valve. But other locking elements are also conceivable. Furthermore, instead of or in addition to the locking elements, flow restrictors, such as for example plates, throttles etc., can be used for regulating the pressure level within the lines, i.e. of the line, the preheating line and/or the cooling steam line.

In addition to the previously described measures, a suction device can be arranged at the side of the delimiting parts facing away from the first pressure chamber above the joint, especially the cross joint, via which leakage amounts can be sucked out. Furthermore there can additionally the provision for a sealing seam to be welded onto the side of the joint facing towards the first pressure chamber, especially the vertical cross joint. In this case it should be ensured that the design of the welded seam is secure and sufficiently flexible for thermal expansion so that damage can be avoided even in non-steady-state processes.

In accordance with the second aspect of the invention the object is achieved by a method for decreasing the pressure acting on a joint which is formed by the joining together of least one first delimiting part and at least one second delimiting part of an apparatus, especially of a steam turbine and for reducing the attachment forces acting on the joint, with the delimiting parts enclosing at least one part of the first pressure chamber, with a shielding element being provided on the sides of the delimiting parts facing towards the interior of the flow channel, which is arranged to form a seal in relation to the least one first delimiting part and at least one second delimiting part and in doing so completely covers the joint, so that a cavity is formed between the delimiting parts and a shielding element, and with a line being routed into the cavity from a second pressure chamber by which the pressure in the cavity can be reduced to a lower level.

The close-fitting covering of the joint on the inside of the delimiting part by the shielding element produces a cavity. A line is routed to the cavity which is connected to a second pressure chamber lying outside the cavity. By connecting the cavity with the second pressure chamber, other operating conditions, especially other temperatures and pressures, can be set in the cavity than in the first pressure chamber. The strain on the joint, especially on the cross joint, is reduced particularly by the lowering of the pressure. It has been shown in such cases that a reduction of the pressure by 15 to 20 bar is possible. Through this method of pressure reduction the usable area of the joint, especially of the cross joint, is greatly increased for steam turbines and other apparatus. I.e. the usable area of a joint connection, especially a cross joint connection, is expanded. The reduction in pressure in the area of the joint or of the cross joint is made possible by a reliable shielding allowing thermal expansion. A correspondingly suitable design of the shielding element achieves a thrust equalization for reducing the flange forces, i.e. the forces acting on the attachment screws of the two delimiting parts. By reducing the pressure in the area of the joint or of the cross joint a reduction of the effective internal pressure-related axial forces of around ⅓ compared to the known apparatus in which no pressure reduction occurs is possible. By shielding the joint or the cross joint, a marked increase in the usable area of such joints can be achieved.

Especially preferred is a method in which the pressure acting on the joint and the attachment forces acting on the joint are decreased or reduced by an apparatus, especially a steam turbine, in accordance with the first aspect of the invention.

BRIEF DESCRIPTION OF THE DRAWINGS

The invention will now be explained in greater detail on the basis of exemplary embodiments which refer to the enclosed drawings. The figures show.

DETAILED DESCRIPTION OF INVENTION

Figure 1:
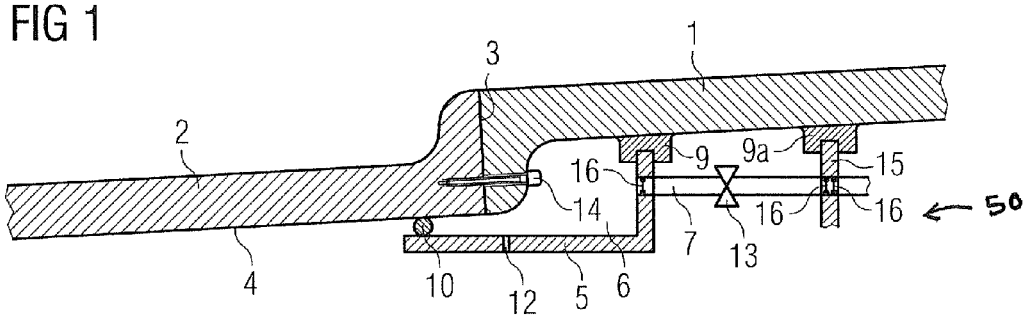
FIG. 1 a section through a schematic diagram of a first option for connecting two delimiting elements of a steam turbine.

FIG. 1 through FIG. 5 show schematic diagrams of different options for connecting two delimiting elements 1, 2 of a steam turbine. On the sides of the delimiting elements 1, 2 which face towards the inside of the flow channel 4 a shielding element 5 is arranged around the area of the joint 3 which is especially embodied as a cross joint. In this case the shielding element 5 covers the joint 3 completely so that a sealed cover to the cavity 6 is produced between the two inner sides of the delimiting elements 1, 2, the joint 3 and the shielding element 5. The shielding element 5 protects the joint from the conditions prevailing in the flow channel or in the first pressure chamber respectively which is formed at least partly by the two delimiting elements 1, 2. In a flow channel or in a pressure chamber within a flow channel of a steam turbine which is in operation there can be prevailing temperatures of over 600° C. and pressures of more than 250 bar. So that the joint 3 or the cross joint is not subjected to these extreme conditions, the shielding element 5 is attached to form a seal around the area of the joint 3 or of the cross joint against the delimiting elements 1, 2. The delimiting elements 1, 2 are embodied as rotationally symmetrical or as essentially rotationally symmetrical elements or subelements. The shielding element 5 is attached to form a seal at an axial area, here at a free end, to a circumferential support 9 arranged on the first delimiting part 1. The circumferential support 9 can also be a stator part of the steam turbine or a web running around the circumference projecting inwards. In this case the shielding element 5 can be suspended to allow at least slight movement on the circumferential support 9. A second axial area, especially the second free end, of the shielding element 5 is arranged sealed against the inner side of the second delimiting part 2. A seal 10 allowing thermal expansion is used for sealing. This seal 10 allowing thermal expansion can for example be a compressible and/or spring-loaded piston ring seal or labyrinth seal. The shielding element 5 has a sealed passage in which a there is a sealed line 7. The line 7 connects the cavity 6 with a second pressure chamber 50 arranged outside the shielding element. Since a lower pressure level obtains in the second pressure chamber 50 than in the inside of the flow channel, the line 7 can bring about a pressure reduction in the cavity 6. The line 7 is preferably embodied flexibly at least in some areas and/or is supported to allow it to move in the passage to the cavity 6. The line 7 is preferably embodied as a pipe. In the passage to the cavity 6 the line 7 is arranged so that it is sealed by a sealing element 16. The line 7 is also attached downstream to a guide vane carrier 15 which is arranged on the circumferential support 9*a*. The second pressure chamber 50 can for example by provided downstream from the guide vane carrier. Preferably the line 7 features a locking element 13, especially in the form of a valve. This locking element 13 enables the conditions, especially the pressure and the temperature within the cavity 6, to be regulated. In this variant of the steam turbine the shielding element features a preheating hole 12 through which a defined quantity of hot steam can be fed continuously into the hollow cavity 6. This is used to improve the non-steady-state behavior of the shielded joint or cross joint. The continuous inflow of a specific quantity of hot steam and the temporary increase able to be achieved in the cavity 6 by closing the locking element 13 in the line 7 makes it possible to temporarily increase the thermal transfer coefficients of the components surrounding the cavity 6. After the desired pressure and temperature level is achieved the locking element 13 and thereby the line 7 can be fully opened again, so that the pressure in the cavity 6 falls again for steady-state operation of the steam turbine. The two delimiting parts 1, 2 have flange connections through which the attachment screws 14 are routed. As an alternative or in addition to the preheating hole 12, there can be provision for the seal allowing thermal expansion 10 to have a specific leakage through which a defined quantity of hot steam can flow continuously into the cavity 6. The shielding of the joint 3 reduces the danger of a leakage at the joint 3. Furthermore the result of lowering of the pressure is a reduction of the forces acting on the attachment screws 14, especially the axial forces.

If two delimiting parts 1, 2 are provided, these are connected to each other at a joint 3. Three delimiting parts form a butt joint and four delimiting parts form a cross joint.

Figure 2:
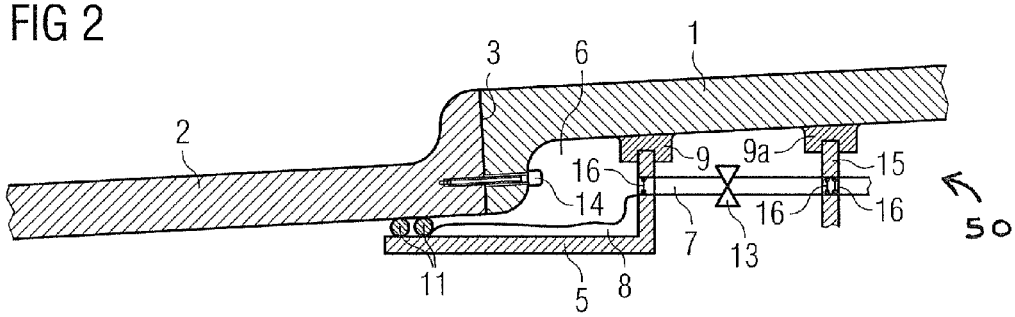
FIG. 2 a section through a schematic diagram of a second option for connecting two delimiting elements of a steam turbine.

FIG. 2 shows a further variant of the sealing of a joint 3 or of a cross joint between at least two delimiting parts 1, 2 of a steam turbine. The variant differs from the variant shown in FIG. 1 in that the seal 10 allows thermal expansion. In this variant the seal 10 allowing thermal expansion is designed in two parts. As well as an enhanced sealing function, the two-part seal 11 has advantages during assembly or dismantling of the shielding element 5 on the at least one second delimiting part 2. Especially preferably the split seal 11 is a piston ring seal in two parts and with two butt ends. The second pressure chamber 50 is formed by the inner space of the at least one first delimiting part 1 and by sealed guide supports employed. The second pressure chamber, as well as being arranged in the flow channel, can also be arranged outside the flow channel, i.e. outside the delimiting parts 1, 2. The flange 8 of the shielding element 5 is used to close off the joint of the shielding element 5 divided into at least two parts.

Figure 3:
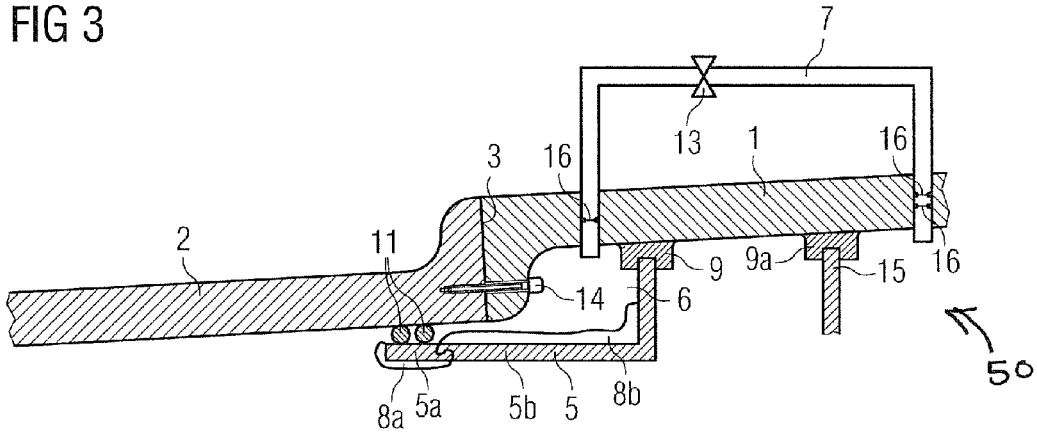
FIG. 3 a section through a schematic diagram of a third option for connecting two delimiting elements of a steam turbine.

The variant of the sealing of a joint 3 or of a cross joint between at least two delimiting parts 1, 2 of a steam turbine shown in FIG. 3 has another route for the line 7 between the cavity 6 and a second pressure chamber 50. The passage to the cavity 6 is provided not in the shielding element but in the first delimiting part 1. The line 7 is routed outside the flow channel, i.e. outside the first delimiting part 1 and is only routed back into the inside of the flow channel 4 in an downstream area and connected there with the second pressure chamber not shown in the diagram. The line 7 is attached in a sealed manner in the passage to the cavity 6 in the at least one first delimiting part 1 by sealing elements. The shielding element 5 is divided in this variant into two segments 5*a*, 5*b*. In this case the shielding element 5 is divided up axially. Arranged on the first shielding segment 5*a* is the seal allowing thermal expansion 10, here in the form of a split seal 11. The second shielding segment 5*b* is fixed on the circumferential support 9 on the inner side of the at least one first delimiting part 1. The split seal 11 makes it possible for the first shielding element segment 5*a* with the split seal 11, after dismantling of the first delimiting part and of the second shielding element segment 5*b*, to be able to be lifted out together with the rotor of the steam turbine provided in the inside of the flow channel and dismantled accordingly. Especially suitable as a split seal 11 is a piston ring seal. To avoid a possible thermal expansion of a component, especially of the first delimiting part 1, the line is preferably supported movably in the passages or embodied flexibly at at least one point. The shielding element segments 5*a*, 5*b* each have a flange 8*a*, 8*b* through which the shielding element segments 5*a*, 5*b* divided up into two can be axially fixed to each other and if necessary to at least one of the delimiting parts 1, 2 and/or to at least one surrounding groove, for example a stator part.

Figure 4:
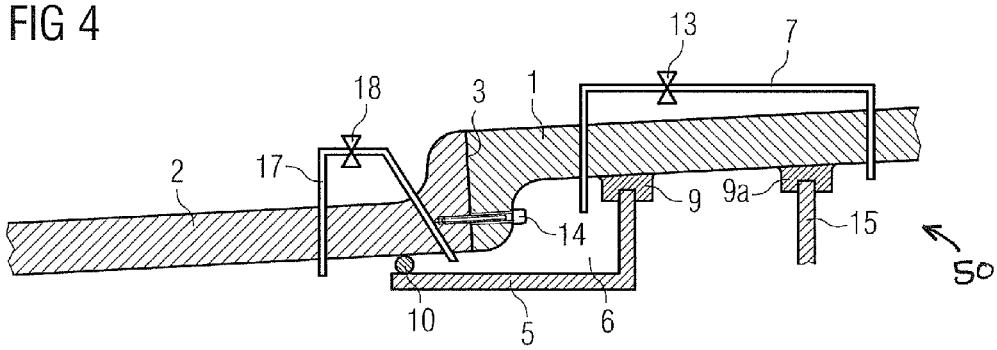
FIG. 4 a section through a schematic diagram of a fourth option for connecting two delimiting elements of a steam turbine.
Figure 5:
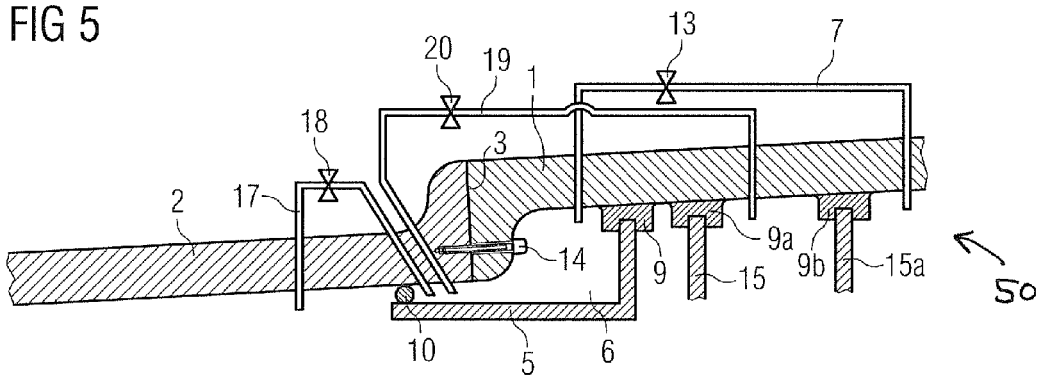
FIG. 5 a section through a schematic diagram of a fifth option for connecting two delimiting elements of a steam turbine.

FIG. 4 shows a further possible variant of the sealing of a joint 3 or of a cross joint between at least two delimiting parts 1, 2 of a steam turbine Instead of a preheating hole or a seal allowing flexible thermal expansion having a leakage, in this embodiment variant a preheating line 17 is routed out of the inside of the flow channel 4 into the cavity 6. In this case the preheating line 17 is not routed with a seal through the shielding element 5 but through the at least one second delimiting part 2. Hot steam can be directed out of the inside of the flow channel 4 or out of the first pressure chamber respectively through the preheating line 17 into the cavity 6 in order to achieve the temporary pressure increase and a raising of the temperature in the cavity 6. For regulating the throughflow of the hot steam the preheating line 17 features a locking element 18, especially a valve. For pressure reduction, as shown in FIG. 3, a line 7 is provided which is routed partly outside the flow channel. When the locking element 18 of the preheating line 17 is opened and the locking element 13 of the line 7 is closed simultaneously the pressure and temperature in the cavity 6 can be temporarily increased.

If a further steady-state temperature lowering and pressure lowering at the joint 3 or the cross joint respectively is to be achieved, for example to maintain permissible usage temperatures of the delimiting parts 1, 2 or of attachment screws 14 or if a reduction of the component temperatures and increase in the design stress values is to be achieved, cooling steam can be directed from a further point lying downstream through a further cooling steam line 19 into the cavity 6 between the shielding element 5, the joint 2 and the delimiting parts 1, 2. The cooling steam 13 fed in can be drained off again through the line 7 which ends at a second point lying further downstream in the flow channel, especially in a third pressure chamber. The pressure in the cavity 6 can be set by the specific line design of the cooling steam line 19 and of the line 7 and a buildup in the line 7, and this can be done at the limits of the pressure level of the first and the second point. However this solution is challenging in control terms and demands a more massive embodiment of the shielding element 5.

The invention claimed is:

1. An apparatus, comprising:

a plurality of delimiting parts including a first delimiting part and a second delimiting part; and a shielding element, wherein the plurality of delimiting parts are attached to each other forming a joint which encloses at least a part of a first pressure chamber, wherein on a side facing towards the first pressure chamber, the shielding element is provided which is arranged against the first delimiting part and the second delimiting part forming a first seal, the arrangement fully covers the joint and forms a cavity between the plurality of delimiting parts and the shielding element, wherein a drain line is routed into the cavity connecting the cavity to a second pressure chamber, wherein the shielding element includes a preheating hole, wherein the sealing element includes a preheating line, which is locked using a first locking element, is routed to the cavity through which hot steam is fed into the cavity, wherein the drain line between the second pressure chamber and the cavity includes a second locking element which is operable to lock the drain line, wherein a cooling steam line which is locked by a third locking element is routed to the cavity through which a cooling steam is fed to the cavity, and wherein a plurality of flow restrictors are provided to control a pressure level within the drain line, a preheating line and the cooling steam line.

2. The apparatus as claimed in claim 1, wherein the joint is a butt joint or a cross joint.

3. The apparatus as claimed in claim 1, wherein each delimiting part is essentially rotationally symmetrical.

4. The apparatus as claimed in claim 1, wherein the drain line to the cavity is routed through one of the plurality of delimiting parts or through the shielding element.

5. The apparatus as claimed in claim 1, wherein the shielding element and a sealing of the shielding element allow thermal expansion.

6. The apparatus as claimed in claim 1, wherein the shielding element is attached to at least two circumferential supports on the plurality of delimiting parts, or the shielding element seats to form the first seal through at least two sealing elements allowing thermal expansion on the plurality of delimiting parts, or the shielding element is attached to a circumferential support on at least one of the plurality of delimiting parts and seats to form a seal through a sealing element allowing thermal expansion on the at least one other delimiting part.

7. The apparatus as claimed in claim 6, wherein one of the circumferential supports is formed by a stator part.

8. The apparatus as claimed in claim 6, wherein the sealing element is seated to form the seal on the circumferential support.

9. The apparatus as claimed in claim 6, wherein the sealing element is formed by a compressible and/or spring-loaded piston ring, or by a labyrinth seal or a transparent seal or by a sealing plate.

10. The apparatus as claimed in claim 6, wherein the sealing element is a split seal.

11. The apparatus as claimed in claim 10, wherein the split seal is arranged on the shielding element and/or on the delimiting part and/or on the circumferential support.

12. The apparatus as claimed in claim 1, wherein the drain line is flexible and/or the drain line is supported to allow movement at least at a passage to the cavity.

13. The apparatus as claimed in claim 1, wherein the shielding element is divided into at least two parts, and wherein the at least two parts of the shielding element are attached to each other to form a second seal.

14. The apparatus as claimed in claim 1, wherein on the sides of the plurality of delimiting parts facing towards the first pressure chamber, a suction device is arranged above the joint in order to suck out leakage.

15. A method for decreasing a force acting on a joint and for reducing the attachment forces acting on the joint, the method comprising:

providing a plurality of delimiting parts which enclose a part of a first pressure chamber;

providing a shielding element on the sides of the plurality of delimiting parts facing the first pressure chamber; and arranging the shielding element against the first delimiting part and the second delimiting part forming a seal, the arrangement completely covering the joint, so that a cavity is formed between the plurality of delimiting parts and the shielding element;

routing a drain line out of a second pressure chamber into the cavity through which a pressure in the cavity is reduced to a lower level, wherein the joint is formed by joining together a first delimiting part and a second delimiting part of the apparatus, the method further comprising;

providing the shielding element with a preheating hole, providing the sealing element with a preheating line, which is locked using a first locking element, is routed to the cavity through which hot steam is fed into the cavity, providing the drain line between the second pressure chamber and the cavity with a second locking element which is operable to lock the drain line, providing a cooling steam line which is locked by a third locking element is routed to the cavity through which a cooling steam is fed to the cavity, and providing a plurality of flow restrictors are provided to control a pressure level within the drain line, a preheating line and the cooling steam line.

* * * * *